US005208419A

United States Patent [19]

Greenhorn et al.

[11] Patent Number: 5,208,419

[45] Date of Patent: May 4, 1993

[54] SHOCK TUBING THAT IS IR TRANSPARENT COLOR-CODED

[75] Inventors: Robert C. Greenhorn, L'Orignal; Jacques Lafond, Lachute, both of Canada

[73] Assignee: ICI Canada Inc., North York, Canada

[21] Appl. No.: 963,425

[22] Filed: Oct. 19, 1992

Related U.S. Application Data

[63] Continuation of Ser. No. 693,886, May 1, 1991.

[51] Int. Cl.[5] ..... C06C 5/04

[52] U.S. Cl. ..... 102/275.4; 102/275.11; 149/123

[58] Field of Search ..... 102/275.4, 275.11; 149/123

[56] References Cited

U.S. PATENT DOCUMENTS 5,109,772 5/1992 Cunningham et al. ..... 102/275.11

5,144,893 9/1992 Zeman et al. ..... 102/275.11 X

*Primary Examiner*—Peter A. Nelson

*Attorney, Agent, or Firm*—Charles Q. Buckwalter, Jr.

[57] ABSTRACT

A method of producing a coloured shock tubing comprising a visibly coloured hollow tube having an inner coating of a reactive material wherein the core loading of the reactive material in the tube may be measured by radiation absorption. The visible colouration of the hollow tube is effected by the addition of a coloured compound, which compound is essentially transparent to the radiation used to measure core loading. A one stage extrusion process may be utilized to prepare a shock tube wherein core loading is easily measured during production, and verified after production.

22 Claims, 1 Drawing Sheet

SHOCK TUBING THAT IS IR TRANSPARENT COLOR-CODED

This patent is a continuation of U.S. Ser. No. 693,886, filed May 1, 1991.

FIELD OF THE INVENTION

This invention relates to shock tubing and, more particularly, to a method of producing coloured shock tubing that facilitates measurement of core loading.

DESCRIPTION OF THE RELATED ART

Persson, in U.S. Pat. No. 3,590,739, first described hollow tubes containing an inner coating of a reactive material, such as a pyrotechnic or explosive composition, which could be used to support the propagation of a gaseous percussion wave throughout the length of the tube. These hollow tubes, commonly known as shock tubes, are widely used by the explosives industry as a non-electric means to cause the initiation of non-electric detonating caps, and thus to cause the ignition of a main explosive charge.

Shock tubes are typically produced by the continuous extrusion of a polymeric resin into a flexible, hollow tube. The inside surface of the tube is coated with a suitable reactive material, which reactive material adheres to the surface of the tube. The tube may be subsequently stretched in order to increase its length.

The production of shock tubes was initially restricted to the use of a limited number of polymers in order to obtain the physical properties which were sought for the product. These properties included the ability to withstand the conditions typically found in blasting environments, while maintaining a sufficient degree if reactive material adherence to the polymer material to ensure the propagation of the gaseous percussion wave throughout the length of the shock tube.

In order to ensure propagation of the gaseous percussion wave, it is essential that a minimum core loading of reactive material is maintained throughout the length of the tube. This minimum core loading varies depending on the type of reactive material used, and on the inner tube diameter, but is generally in the order of 20 mg of reactive material per running meter of 1.3 mm inside diameter shock tube, or about 4.4 g/m$^2$ of internal tube area.

Measurement of the core loading of shock tubing is conveniently performed during production by exposing the shock tube produced to a radiation source, generally an infrared (IR) light source, which radiation is absorbed by the reactive material on the inner surface of the shock tube.

The radiation used for measuring the core loading is essentially not absorbed by the polymer of the hollow tube since absorbance by the polymer would either prevent or interfere with the determination of the core loading. Thus, the core loading of the reactive material in the shock tubing can be determined by measuring the level of absorption of the radiation which passes through the shock tube since the absorbance of the radiation is related to the core loading of the shock tubing.

One method to improve the physical characteristic of shock tubing has been to provide a laminated product made of at least two layers of different polymeric resins. The inner layer is a polymer having sufficient adherence properties to maintain the minimum core loading of the reactive material, and allows core loading to be measured since the polymer is sufficiently transparent to the radiation used for measuring core loading. An outer layer of polymeric material is extruded over the inner tube layer and has the necessary physical properties to withstand the conditions encountered during use.

The properties of the laminated, or two layer, shock tubes can be further enhanced by the addition of strands or cords of reinforcing materials between the inner and the outer layers of polymeric materials in order to reduce stretching of the tube on site.

A further improved feature of commercial shock tubing has been to colour the outer layer of polymeric material in order to make the shock tubing more visible on-site, and to colour code the shock tube according to use, length, or shock tube propagation velocity. This outer layer of coloured polymeric material is generally visually opaque and blocks common sources of radiation from passing through the shock tube.

While blocking of radiation is desirable in order to reduce ultra-violet (UV) light from passing through the tube and causing the potential degradation of the polymeric material and the potential UV induced desensitization of the reactive material, the outer layer of coloured polymeric material also blocks the radiation frequencies used to measure the core loading of the shock tube.

In commercial practice, it is, therefore, necessary to measure the core loading of the shock tube prior to extruding the outer layer of coloured polymeric material over the inner layer polymeric material, since it has not been possible to measure core loading through the outer layer of coloured polymeric material.

While the two layer shock tubes of the prior art are commercially viable, it would be desirable to reduce the cost of the layer shock tube of the prior art.

In the U.K. patent application No. 8802329, a single layer shock tube is described which is produced from an extruded blend of polymeric materials, which material blend provides a shock tube with suitable physical characteristics. Unfortunately, the presence of typical colouring materials in the material blend used to extrude the single layer shock tube would result in the inability to measure the core loading of the shock tube using conventional radiation absorption equipment.

SUMMARY OF THE INVENTION

It has now been found that coloured shock tubing can be produced by using a coloured compound to effect colouration of the shock tube, which coloured compound is sufficiently transparent to radiation to allow the core loading of the coloured shock tube to be measured.

It is an object of the present invention to provide a coloured shock tube which permits core loading of the reactive material to be measured, after the shock tubing has been coloured, using radiation absorption equipment.

Accordingly, the present invention provides a method of producing shock tubing, which shock tubing has a hollow tube with an inner core loading of a reactive material for the propagation of a shock wave within said tube, and which reactive material absorbs radiation of a selected frequency, which process comprises:

forming a visually coloured hollow tube having an inner surface and an outer surface; and coating the inner surface of said tube with a core loading of said reactive material, characterized in that said visually coloured hollow tube is essentially transparent to said radiation.

The coloured compound can be selected from the group consisting of fillers, pigments, or dyes, and may be blended into, and form part of the tube or may be a coating on the surface of the tube.

The coloured shock tubing is, preferably, produced by the addition of suitable coloured fillers, pigments, or, preferably, dyes to the polymeric resin mixture used in the manufacture of the hollow tube. Suitable colouring materials can be discrete organic dyes, or may be, for example, pigments prepared by a "Lake" process. For example, materials, such as diazo, disazo, or Lake based pigments may be used. In this manner, shock tubing can be produced which can be, for example, yellow, red, orange, blue, green, or violet.

The resultant visually coloured, hollow tube, when viewed in the absence of reactive material, may be partially transparent, translucent or opaque to visible light.

The polymeric resin of the shock tube of the present invention must be sufficiently transparent to the radiation frequency used so that a sufficient amount of radiation passes through the polymeric resin to allow the core loading to be measured. The polymeric resin is, preferably, a polyethylene based material such as, for example, linear low density polyethylene, ultra low density polyethylene, or low density polyethylene and can include blends or copolymers of the above resins with other resins or monomers such as ethylene/vinyl acetate, vinyl acetate, or ethylene/acrylic acid.

The reactive material can be any suitable material for the propagation of the gaseous percussion wave, but must absorb the radiation at the frequency used for measuring core loading. If necessary, suitable fillers which absorb at a desired radiation frequency, can be added to the reactive material which fillers will absorb radiation at the selected frequency used.

Preferably, the radiation frequency used is a near infrared radiation frequency, and, more preferably, is a broad band peaking at 900 nm.

In a further preferred feature, it is desirable to provide a method to produce a coloured shock tube according to the present invention, as hereinabove described, wherein the coloured shock tube absorbs UV radiation so that UV degradation of the polymer or the reactive material is avoided. This can be accomplished by the addition of a UV absorbing material to the polymeric resin used to produce the hollow tube.

The present invention, thus, provides a method of producing a shock tubing which comprises:

mixing a coloured compound with a polymeric resin to produce a coloured polymeric resin;

extruding said coloured polymeric resin to form a visually coloured hollow tube having an inner surface and as outer surface; and coating the inner surface of said tube with a core loading of a reactive material, which reactive material absorbs radiation of a selected frequency.

While it is preferable, in the present invention, to have a single extrusion process to provide a single walled shock tube, as described hereinabove, it is also possible to use the present invention to provide a coloured over-extruded shock tube, wherein a suitable colouring compound is included in any one of the polymeric resin layers of a multi-layer shock tube.

Further, it is also possible to coat the inner, or, more preferably, the outer surface of the hollow tube of the shock tubing with a coloured coating material, which coating material comprises the coloured compound and will adhere to the hollow tube to provide a thin coating on the surface of the tube, and which coating material is essentially transparent to the radiation frequency used.

Thus, the present invention also provides a method of producing a shock tubing which comprises:

extruding a hollow tube having an inner surface and an outer surface;

coating the inner surface of said tube with a core loading of a reactive material, which reactive material absorbs radiation of a selected frequency; and coating the outer surface of said tube with a coating material, which coating material comprises a coloured compound, wherein said coating material and said hollow tube are essentially transparent to said radiation.

In a further aspect, the present invention also provides a shock tubing produced according to a process as hereinbefore defined.

In a still further aspect, the present invention also provides a method of determining the core loading of shock tubing comprising:

preparing shock tubing according to the methods defined hereinabove;

exposing said shock tube to a radiation source having a frequency range which is absorbed by said reactive material, and which is essentially not absorbed by said hollow tube or said coloured compound; and measuring the absorption of said radiation.

BRIEF DESCRIPTION OF THE DRAWINGS

The invention will now be described, by way of example only, with reference to the following figures, wherein:

In FIG. 1, a shock tube 10 is shown having a single wall hollow tube 11 having an inner coating of a reactive material 12.

Tube 11 is coloured and comprises a mixture of 80% linear low density polyethylene (LLDPE), 10 % of a low functionality ethylene-vinyl acetate resin (EVA) having 2% vinyl acetate, and 10% ethylene-acrylic acid. The tube is coloured by the addition of a yellow disazo dye, as a coloured compound, to produce a yellow hollow tube.

The reactive material 12 comprises a mixture of HMX (cyclotetramethylene tetranitramine) and aluminum. Reactive material 12 absorbs IR radiation from an IR radiation absorption means having a frequency peaking at 900 nm while coloured tube 11 does not absorb sufficient IR radiation at the stated frequency to substantially interfere with the measurement of the IR absorption of the reactive material.

Other resin blends, such as for example, those resin blends described in U.K. Patent application No. 8802329, may be utilized provided that acceptable shock tubing properties are obtained.

Figure 1:
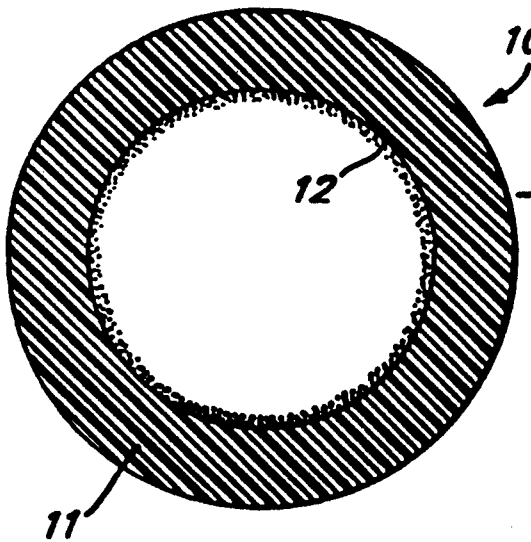
FIG. 1 is a cross-sectional drawing of a single layer shock tubing according to the present invention.

The coloured shock tube of FIG. 1 is produced by the following process described with reference to FIG. 2.

Figure 2:
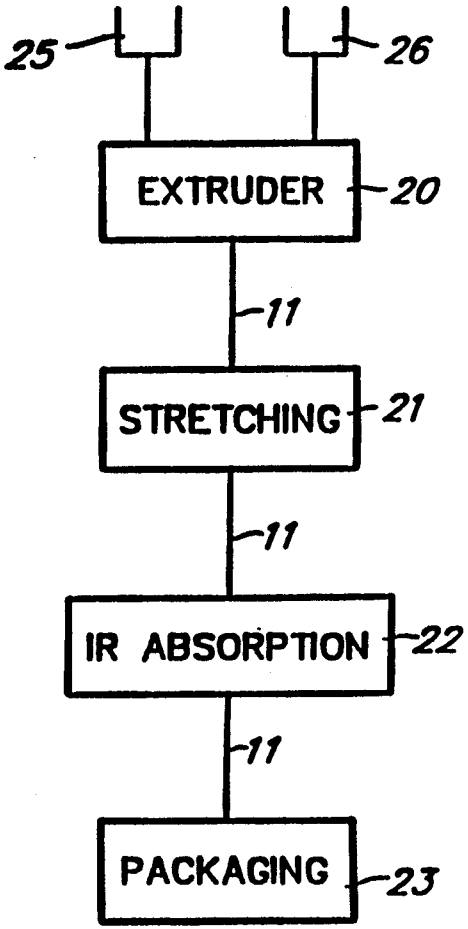
FIG. 2 is a schematic drawing of a production facility to produce the shock tubing described in FIG. 1.

In FIG. 2, an extruder 20 is shown having supply hoppers 25 and 26. The product exiting extruder 20 is fed in series through a stretching means 21, an IR absorption means 22, and a packaging means 23.

In extruder 20, a mixture of polymeric resin pellets and coloured compound are fed from hopper 25 to extruder 20 and is extruded at a temperature of about 205° C. into a continuous hollow yellow tube 11. Reactive material 12 is fed from hopper 26 into a mandrel located within the centre of the extrusion die.

The coloured compound may be added separately to hopper 25, but is, preferably, added as pellets of a preblended concentrated "masterbatch" mixture of coloured compound and polymeric resin. Masterbatches of suitable materials of use in the present invention are commercially available from Korlin Concentrates as Korlin Colour Numbers YE 9571 or RD 9575 which are, respectively a disazo and a Lake red pigment. The pigments have been blended into a linear low density polyethylene resin. Additional property enhancing materials, such as for example, benzotriazole U.V. absorbers may also be added to the masterbatch.

Material 12 is allowed to fall into tube 11 at a controlled rate, as tube 11 is forming, and adheres to the inner walls of the tube 11 produced. The resultant shock tube 10 thus produced, is allowed to cool and is passed through stretching means 21 which stretches shock tube 10 to provide a six-fold increase in the length of the tube. After stretching, shock tube 10 has a 3 mm outside diameter, a 1.3 mm inside diameter, and a core loading of 18 mg/m.

Stretched shock tube 10 is fed to IR absorption means 22 wherein IR radiation having a frequency peaking at 900 nm is directed through shock tube 10. The absorption of the radiation which passes through shock tube 10 is measured and compared to a calibrated standard level of absorption. Thus, the core loading level of shock tube 10 is determined by comparison of the IR absorption of the shock tube produced to the IR absorption of known standards. Shock tube 10 is finally fed to packaging means 23 wherein the shock tube 10 is wound onto cylindrical drums.

Additional shock tubing production details are more fully described in U.K. Patent application No. 8802329.

The resultant shock tube is coloured and has acceptable properties for explosive industry use. Verification of the core loading of the tube produced can be accomplished at any time by passing the tube through an IR absorption means similar to the means used during production.

Figure 3:
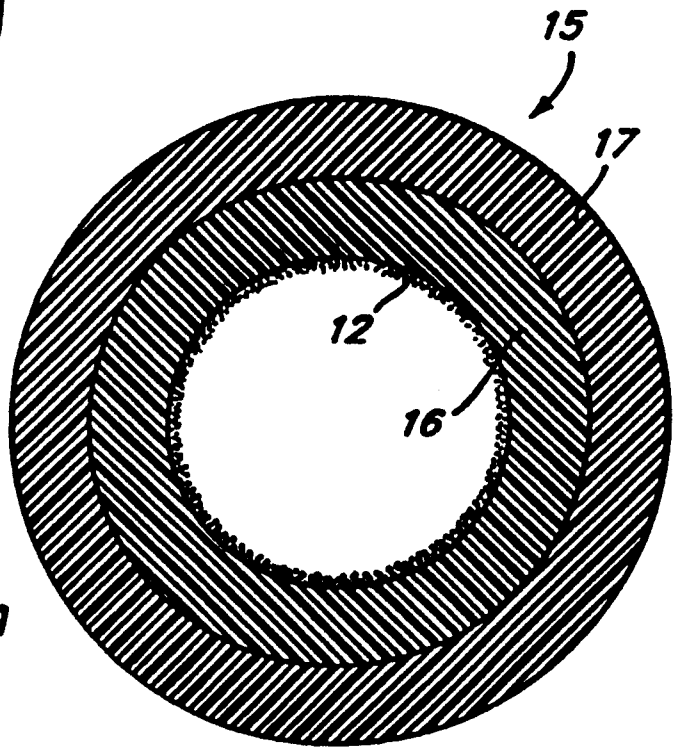
FIG. 3 is a cross-sectional drawing of a two-layer shock tubing according to the present invention.

A second embodiment of the present invention is shown in FIG. 3 wherein a cross-sectional view of a multiple layer shock tube 15 is shown. Shock tube 15 has an inner hollow tube 16 over which an outer layer 17 of polymeric material has been over extruded. The inner hollow tube 16 has an inner coating of a reactive material 12.

Inner tube 16 is a colourless tube which has been prepared by extrusion of Surlyn TM, or in general, a polymeric material which suitable adhesive properties for the reactive material 12 to remain on tube 15. Reactive material 12 is the same HMX/aluminum mixture described in FIG. 1.

After inner tube 16 has been formed, outer layer 17 which comprises a linear low density polyethylene (LLDPE) and a coloured compound as described with respect to FIG. 1, is over extruded.

Measurement of the core loading of shock tube 15 can still be determined by measuring the absorption of IR radiation projected through shock tube 15.

We claim:

1. A method of producing shock tubing, which shock tubing has a hollow tube with an inner core loading of a reactive material for the propagation of a shock wave within said tube, and which reactive material absorbs radiation of a selected frequency, which process comprises:

forming a visually colored hollow tube comprising a colored compound, and having a inner surface and an outer surface; and coating the inner surface of said tube with a core loading of said reactive material, characterized in that said visually colored hollow tube is essentially transparent to infrared and near infrared radiation.

2. A shock tube comprising an inner surface and an outer surface, said inner surface coated with a core load of reactive material said shock tube characterized by the improvement comprising a colored hollow tube essentially transparent to IR or near IR radiation.

3. The shock tube in claim 2 wherein said shock tube color is selected from the group consisting of diazo dyes, disazo dyes, Lake dyes, and combinations thereof.

4. The shock tube in claim 2 wherein said shock tube color is selected from the group consisting of yellow, red, orange, blue, green, violet, and combinations thereof.

5. The shock tube in claim 2 wherein said shock tube comprises a polymeric resin.

6. The shock tube in claim 5 wherein said resin is selected from the group consisting of linear low density polyethylene, ultra low density polyethylene, low density polyethylene, and blends and copolymers thereof.

7. The shock tube in claim 2 wherein said radiation consists of a broad band peaking at 900 nm.

8. The shock tube in claim 2 wherein said reactive material consists of a mixture of HMX and aluminum.

9. The shock tube in claim 2 wherein said shock tube is bilaminate.

10. The shock tube in claim 2 wherein said shock tube consists of a single walled shock tube combined with a colored over-extruded shock tube.

11. The shock tube in claim 2 wherein said color coats said inner surface.

12. The shock tube in claim 2 wherein said color coats said outer surface.

13. The shock tube of claim 2, wherein said shock tube is essentially opaque to ultraviolet radiation.

14. A method of producing shock tubing, wherein said shock tubing comprises a hollow tube, an inner surface and an outer surface, said inner surface coated with a core load of reactive material comprising the steps of:

a) forming a colored hollow tube with an inner and a outer surface, b) coating said inner surface with a core load of reactive material, c) measuring said core load with IR or near IR radiation.

15. The method in claim 14 wherein said color is selected from the group consisting of yellow, red, orange, blue, green, violet, and combinations thereof.

16. The method of claim 14 wherein said color is selected from the group consisting of diazo dyes, disazo dyes, Lake dyes, and combinations thereof.

17. The method of claim 14 wherein said shock tubing comprises a polymeric resin.

18. The method of claim 14 wherein said reactive material consists of HMX and a aluminum.

19. The method of claim 14 wherein said radiation consists of a broad band peaking at 900 nm.

20. The method of claim 14 wherein said shock tubing is bilaminate.

21. The method of claim 14 wherein said shock tubing consists of a single walled shock tube combined with a colored over-extruded shock tube.

22. The polymeric resin of claim 17 wherein said resin is selected from the group consisting of linear low density polyethylene, ultra low density polyethylene, low density polyethylene, and blends and copolymers thereof.

* * * * *